US005925278A

United States Patent [19]

Hirst

[11] Patent Number: 5,925,278

[45] Date of Patent: Jul. 20, 1999

[54] UNIVERSAL POWER SUPPLY FOR MULTIPLE LOADS

[75] Inventor: B. Mark Hirst, Boise, Id.

[73] Assignee: Hewlett-Packard Company, Palo Alto, Calif.

[21] Appl. No.: 08/697,387

[22] Filed: Aug. 23, 1996

[51] Int. Cl.[6] ..... H05B 6/08

[52] U.S. Cl. ..... 219/662; 219/665; 219/667; 219/671; 307/31; 307/39; 363/21

[58] Field of Search ..... 219/661, 662, 219/663, 665, 667, 601, 671; 307/36, 38, 39, 31; 363/21, 89

[56] References Cited

U.S. PATENT DOCUMENTS

| | | | |
|---|---|---|---|
| 4,002,875 | 1/1977 | Kiuchi et al. | 219/601 |
| 4,129,767 | 12/1978 | Amagami et al. | 219/662 |
| 4,241,250 | 12/1980 | Steigerwald | 219/661 |
| 4,320,273 | 3/1982 | Kiuchi | 219/662 |
| 4,469,926 | 9/1984 | Komuro | 219/710 |
| 4,900,884 | 2/1990 | Aoki | 219/601 |
| 4,928,055 | 5/1990 | Kaieda et al. | 323/300 |
| 5,349,167 | 9/1994 | Simcock | 219/667 |
| 5,483,149 | 1/1996 | Barrett | 323/300 |

*Primary Examiner*—Philip H. Leung
*Attorney, Agent, or Firm*—Anthony J Baca

[57] ABSTRACT

The present invention provides a circuit for heating a heating element to a desired temperature and generating an output from a single common AC power source. First, the AC power is rectified. An inductor and a capacitor form an L section type filter for the DC from the rectifier. The inductor and the capacitor have a resonate frequency that is greater than the AC power frequency. A switch is connected to the heating element. Next, a controller receives a signal that indicates the actual temperature of the heating element along with an indication of the desired temperature. The controller generates an error signal that PWMs the switch thereby controlling the heating element. Another switch is connected to a transformer. A separate controller PWMs the second switch generating the output at the secondary side of the transformer. The two controllers use a pulse width modulating frequency that is greater than the resonate frequency of the inductor and capacitor. The output of the transformer is rectified by a diode and then filtered by a large capacitor. The intermediate voltage across the capacitor is fed-back to the second controller which in-turn changes the PWM signal to regulate the intermediate voltage. Finally, several power converters convert the intermediate voltage to the desired working voltages.

13 Claims, 7 Drawing Sheets

UNIVERSAL POWER SUPPLY FOR MULTIPLE LOADS

CROSS-REFERENCE TO RELATED APPLICATION

The present application is related to the following co-pending U.S. Patent applications being assigned to the same assignee and filled on the same date, entitled:

"USE OF THE TEMPERATURE GRADIENT TO DETERMINE THE SOURCE VOLTAGE", Ser. No. 08/704,217, filed, Aug. 23, 1996 incorporated herein by reference;

"A REDUCED FLICKER FUSING SYSTEM FOR USE IN ELECTROPHOTOGRAPHIC PRINTERS AND COPIERS", Ser. No. 08/704,216, filed, Aug. 23, 1996 U.S. Pat. No. 5,789,723 incorporated herein by reference; and "A METHOD FOR REDUCING FLICKER IN ELECTROPHOTOGRAPHIC PRINTERS AND COPIERS", Ser. No. 08/701,899, filed, Aug. 23, 1996 U.S. Pat. No. 5,811,764 incorporated herein by reference.

TECHNICAL FIELD

This invention relates generally to power control systems and more particular an arrangement that allows a switching power supply and fusing system to share input circuitry.

BACKGROUND OF THE INVENTION

Starting in approximately 1984, low cost personal laser printers became available. All dry electrophotographic copiers and printers develop an image utilizing a dry toner. The typical toner is composed of styrene acrylic resin, a pigment-typically carbon black, and a charge control dye to endow the toner with the desired tribocharging properties for developing a latent electrostatic image. Styrene acrylic resin is a thermo-plastic which can be melted and fused to the desired medium, typically paper.

For a dry electrophotographic system to operate worldwide it must be able to operate satisfactorily on AC power systems providing from 90 Vrms to 240 Vrms at frequencies of 50 Hz to 60 Hz. The AC power operates two major sub-systems within the electrophotographic system. A switching power supply supplies power for the electronics, motors and displays. Power requirements for the switching power supply varies, but is generally under 100 watts. The second major sub-system in an electrophotographic system is the fusing system. The typical fusing system is composed of two heated platen rollers which, when print media with a developed image pass between them, melt the toner and through pressure physically fuse the molten thermal plastic to the medium. Heating is usually accomplished by placing a high power tungsten filament quartz lamp inside the hollow platen roller. As with the switching power supply, the fusing system power requirement varies between printers but is on the order of 1,000 watts.

The combination of the electrophotographic printer, switching power supply, fusing system and power electronics when must meet International Electrical Commission (IEC) regulations IEC 555-2 and IEC 555-3 for current harmonics and flicker. The printer must pass Federal Communications Commission (FCC) class B regulations for power line conducted emissions and radiated emissions. In addition, the printer must pass CISPR B requirements for power line conducted emissions and radiated emissions. Finally, the printer must not suffer from excessive acoustic multi-tone or single tone emissions in the human auditory range in the office environment. The electrophotographic system must be capable of switching into a power down or power off mode for energy savings as suggested by the EPA Energy Star Program.

Prior to the present invention, a power factor correction type switching power supply most commonly has a boost regulator situated in the "front end" to pre-regulate and shape the waveform of the current so that it is close to a sinusoid and in phase with the input voltage. Such an arrangement may have considerable power conversion losses. Additionally, the cost of the additional electronics required for the boost converter adversely impact the overall cost. Other solutions consisted of a power factor correction type switch mode power supply connected to the AC power source in parallel when a standard triac based fuser controller, which had very good power factor but suffered from excessive flicker and did not possess a universal fuser.

SUMMARY OF THE INVENTION

The present invention provides a circuit for heating a heating element to a desired temperature and generating an output from a single common AC power source. First, the AC power is converted to DC by a rectifier. An inductor and a capacitor form an L type filter for the DC from the rectifier. The inductor and the capacitor have a resonate frequency that is greater than the AC power frequency.

A switch is connected to the heating element and the rectifier. Next, a controller receives a signal that indicates the actual temperature of the heating element along with an indication of the desired temperature. The controller generates an error signal that switches the switch off and on thereby heating the heating element to the desired temperature. Another switch is connected to a transformer and the rectifier. A separate controller turns the second switch off and on thereby generating the output at the secondary side of the transformer. The two controllers use a pulse width modulating frequency that is greater than the resonate frequency of the inductor and capacitor.

The output of the transformer is rectified by a diode and then filtered by a large capacitor. The intermediate voltage across the capacitor is feedback to the controller which in-turn changes the PWM signal to regulate the intermediate voltage. Finally, several power converters convert the intermediate voltage to the desired working voltages.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
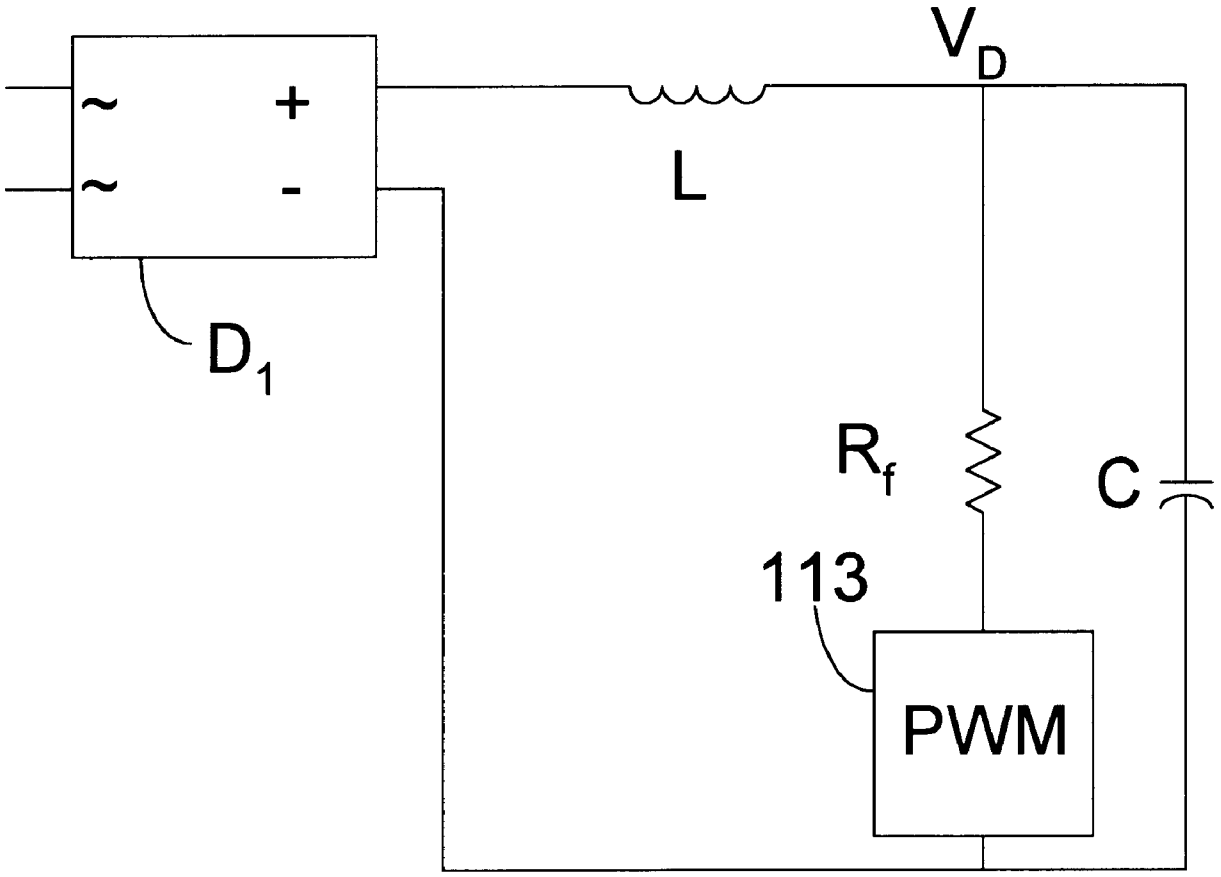
FIG. 1 is a schematic diagram showing the fusing system electronics.

The present invention is not limited to a specific embodiment illustrated herein. The circuit of FIG. 1, which is described in detail in "A REDUCED FLICKER FUSING SYSTEM FOR USE IN ELECTROPHOTOGRAPHIC PRINTERS AND COPIERS", Ser. No. 08/704,216, filed Aug. 23, 1996, utilizes the input inductor L of the boost converter topology to average the current drawn by the converter thereby greatly reducing the current harmonics presented to the AC line. This topology linearly controls the average current drawn by the load $R_f$ and thus the average power drawn by the load varies linearly with duty cycle. The capacitor C provides a continuous current path for the input filter inductor L current when the filament $R_f$ is switched out of circuit by the PWM 113.

Figure 2:
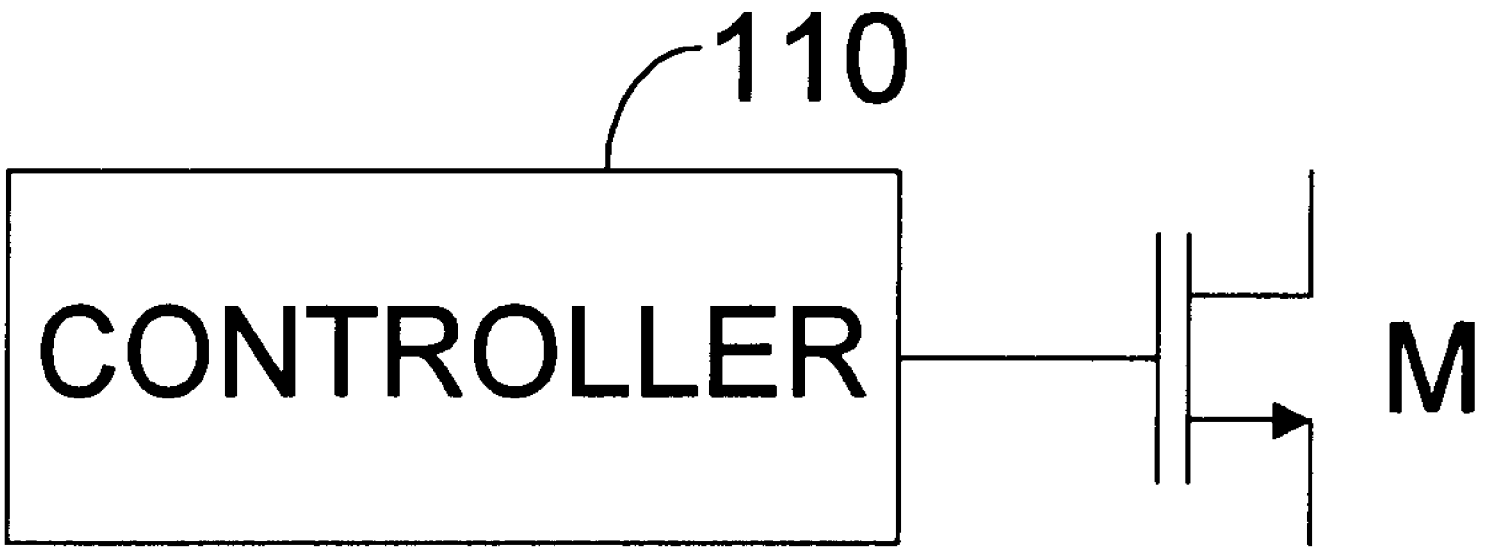
FIG. 2 is a simplified schematic diagram of a PWM.

FIG. 2 shows a simplified schematic diagram of a PWM. Some type of controller 110 switches a transistor M thereby switching the load in and out of the circuit. The exact implementation of the controller is design specific as one skilled in the art will understand.

Unlike a standard DC—DC voltage converter, which controls a load voltage as its power requirements change by modifying the duty cycle of a pulse width modulator, this converter controls the AC power supplied to a printer fusing system heating element R and hence the temperature of the fusing system.

Figure 3:
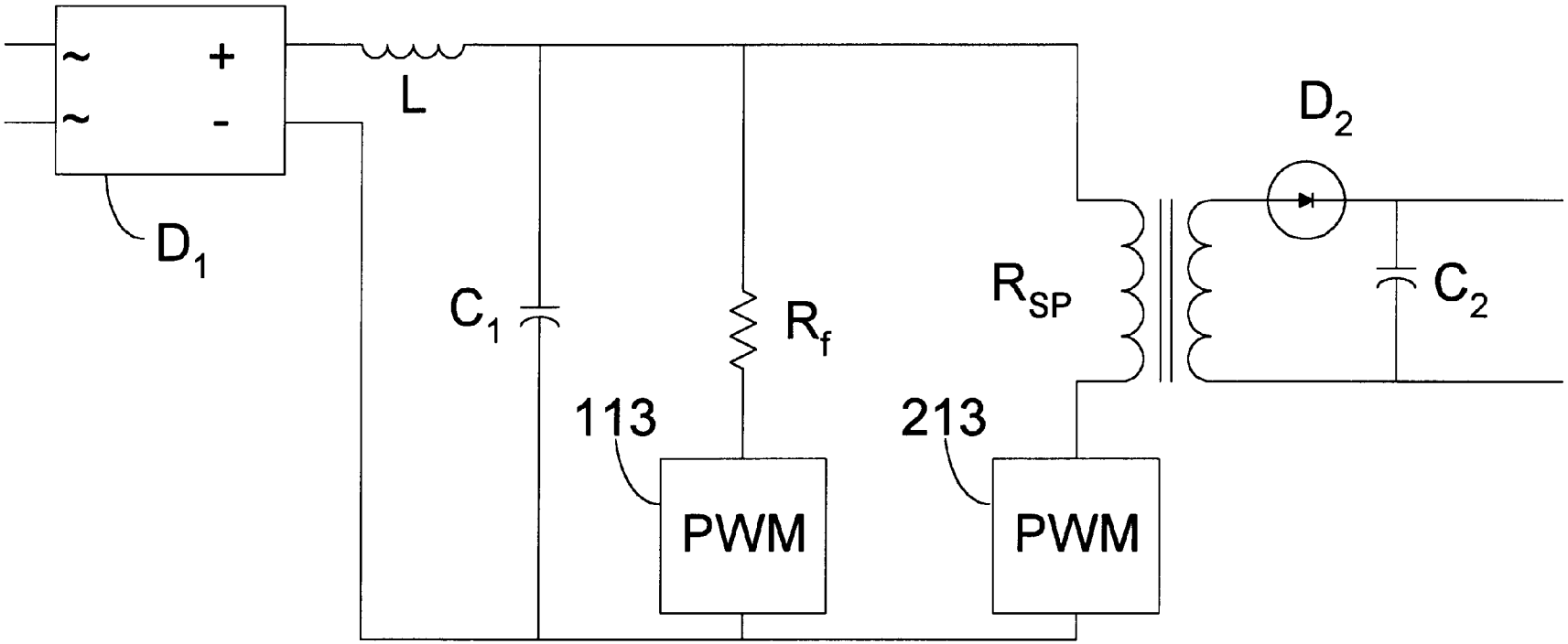
FIG. 3 is a simplified schematic diagram of an alternative embodiment in accordance with the present invention.

The circuit of FIG. 3 show a simplified circuit of the preferred embodiment of the present invention. With properly selected filter components L and $C_1$ and a large enough resistive power load, $R_f$ and $R_{SP}$, which completely discharge filter capacitor $C_1$ every half cycle of the input line fundamental frequency causes input inductor L to experience continuous conduction over nearly the entire AC half-cycle, the AC power source essentially sees a resistive load, i.e. a dominant current in phase with the AC voltage source. The result is that a near unity power factor is obtained for a wide range of duty cycles and their associated power levels.

For the power converter topology of FIG. 3, the parallel resistive loads $R_f$ and $R_{SP}$ are switched into and out of circuit several hundred times per AC half cycle which causes an effective resistive load to appear. The effective resistive load can be found by equating the average power supplied to a resistive load to that consumed by the duty cycle pulse width modulated resistive load as shown in eqs. 1 and 2.

$$R_{f/df} = \frac{R_f}{d_f} \qquad \text{eq. 1}$$

and;

$$R_{SP/dSP} = \frac{R_{SP}}{d_{SP}} \qquad \text{eq. 2}$$

The effective resistive load presented by the power controller to the AC source is:

$$R_{eff} = \frac{R_f}{d_f} \Big\| \frac{R_{SP}}{d_{SP}} = \frac{R_f \cdot R_{SP}}{R_f \cdot d_{SP} + R_{SP} \cdot d_f} \qquad \text{eq. 3}$$

where $d_f$ is the duty cycle of PWM 113 and $d_{SP}$ is the duty cycle of PWM 213.

Thus, as long as the input inductor L is always in continuous conduction the AC source essentially sees a resistor whose value is controlled by the duty cycles of the PWMs. To ensure continuous conduction as well as spread the power spectrum of any higher frequency emissions, PWM 113 and PWM 213 should be switched out of phase of each other, although they may be in-phase as well.

In order to reliably control the power levels associated with the electrophotographic printer, approximately 1 kW, special attention to the selection of the components is necessary. Selection of the filter components must also take into consideration the necessity of controlling the current harmonics, the input power frequency, the switching frequency as well as the cost of the filter components.

For optimal operation current filter inductor L must possess several attributes. Because inductor L handles the full current of the load the first attribute is an extremely low series resistance which is necessary in order to minimize $i^2*R$ losses. The second attribute is that inductor L be relatively small and, for high values of inductance, this necessitates an iron or ferrite core. Thirdly, inductor L must possess a very high saturation current. To handle large currents and the resulting magnetic flux densities without saturating dictates that the inductor be constructed with an iron core. Fourth, to minimize conducted emissions the inductor must be designed with the lowest possible inter-winding parasitic capacitance. Finally, the inductor core should be designed to minimize core losses.

Filter capacitor C is subjected to strenuous demands that affect the capacitor type and ratings that the capacitor must possess. The filter capacitor must be able to withstand continuous voltages in excess of 339 Volts and must withstand repetitive current surges of greater than 160 amperes. The filter capacitor is experiencing repetitive high current surges with each energization and deenergization of the PWMs. To avoid excessive power dissipation in and heating of the capacitor, the filter capacitor should exhibit an extremely low equivalent series resistance, ESR. The capacitance exhibited by the capacitor should also remain nearly constant over the entire range of frequencies that it may experience as the duty cycle of the converter changes. In order to meet these requirements a motor-run type capacitor is ideal. This type of capacitor is relatively inexpensive, considering its attributes, and is used in large quantity throughout the world for commercial AC motor applications.

The filter components of the power control topology of FIG. 3 form a resonant tank circuit with a natural frequency, $\omega_o$, of $$\omega_o = \frac{1}{\sqrt{L \cdot C}} \qquad \text{eq. 4}$$

In order to obtain the desired benefit of extremely low harmonic current content the resonant frequency of the power filter, $\omega_o$, must be placed as far away from the input power frequency, $\omega_p$, as possible. Further, to avoid exciting the resonant circuit formed by the power filter components the switching frequency of the power switch, $\omega_s$, should be placed as far away from the power filter resonant frequency as possible. If the resonant frequency of the power filter is placed at least an order of magnitude above the input power frequency and the switching frequency is placed at least an order of magnitude greater than the resonant frequency of the power filter then the proposed power converter topology should have very good control over current harmonics as well as not induce excessive excitation of the power filter tank. These criteria for filter resonant frequency placement are represented as $$\omega_p << \omega_o << \omega_s \qquad \text{eq. 5}$$

Additionally, in order to present a nearly resistive load to the AC power source the criteria of equation 6 must be satisfied. The magnitude of the impedance of the input inductor at the frequency of the power source, 50 Hz or 60 Hz, must be much less than the expected resistive load and that the magnitude of the impedance of the filter capacitor must be much larger than the expected resistive load.

$$|j\cdot\omega\cdot L| \ll R_{eff} \ll \left|\frac{1}{j\cdot\omega\cdot C}\right| \quad \text{eq. 6}$$

As long as the power filter inductor is in continuous conduction for nearly the entire AC half cycle the power factor is almost completely dominated by the displacement power factor. Also, as long as the power filter resonant frequency and the filament switch frequency are placed far enough apart then the current distortion due to switching current harmonics will be minimal and the current distortion factor, cdf, will be near unity.

Power factor, PF, is typically composed of the displacement power factor, dpf, multiplied by the current distortion factor, cdf, and is expressed as $$PF=dpf\cdot cdf \quad \text{eq. 7}$$

where the displacement power factor is defined as the cosine of the impedance phase angle, cos(θ).

If it is assumed that there is no current distortion then the power factor is dependent entirely on the displacement power factor and easily calculated from the load impedance phase angle, θ, therefore the power factor will be assumed to be:

$$PF=\cos(\theta) \quad \text{eq. 8}$$

First pass selection of filter capacitor C can be made at very low loads where the power quality starts to degrade. First a desired power factor is chosen at an assumed power level of 70 watts.

$$PF=\cos(\theta)=0.99 \quad \text{eq. 9}$$

Thus, $$\theta=8.11 \quad \text{eq. 10}$$

Also, for the assumed power level of 70 W;

$$R_{f/df} = \frac{R_f}{d_f} = \frac{V^2}{P} = \frac{120}{70} \cong 200\Omega \quad \text{eq. 11}$$

Figure 4:
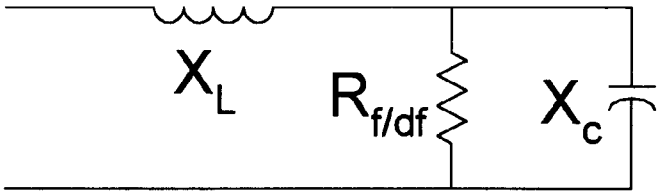
FIG. 4 is a model of FIG. 1.

A value of C can be found with the aid of FIG. 4. The impedance of the circuit is:

$$Z = X_L + R_{f/df}\left\|X_c = j\omega L + \frac{R_{f/df}}{j\omega CR_{f/df}+1}\right. \quad \text{eq. 12}$$

However, the effect of the inductance will be insignificant enough that it can be eliminated for now. Thus, the impedance is can be given by:

$$Z = \frac{R_{f/df}}{j\omega CR_{f/df}+1} = \frac{R_{f/df}(1-j\omega CR_{f/df})}{1+\omega^2C^2R_{f/df}^2} = Z\angle\theta = Z[\cos(\theta)+j\sin(\theta)] \quad \text{eq. 13}$$

Thus:

$$\theta = \tan^{-1}\left[\frac{\text{Imagery Part}}{\text{Real Part}}\right] \quad \text{eq. 14}$$

$$\theta = \tan^{-1}[\omega CR_{f/df}] \quad \text{eq. 15}$$

$$\tan(\theta) = \omega CR_{f/df} \quad \text{eq. 16}$$

where the frequency of the power source is assumed to be 60 Hz. Solving equation 16 for C:

$$C = \frac{\tan(\theta)}{\omega R_{f/df}} = 2\mu F \quad \text{eq. 17}$$

First pass selection of filter inductor L may be made at any load. A first pass selection will be made by picking a particular resonant frequency.

$$\omega_o = \frac{1}{\sqrt{L\cdot C}} \quad \text{eq. 18}$$

Selecting $F_o$=7.9 Khz and solving for the inductance yields a value for the inductor of 200 $\mu$H. Actually, the larger that the value of the inductor can be specified the better the resulting filtered current will become. However, in order to avoid unnecessary expense the filter inductor should be as small as possible. Again, in order to minimize conducted emissions the inductor should be designed to have the lowest possible interwinding parasitic capacitance.

Using the above values results in a power factor of:

$$Z=195.55-j29.4127=197.745\angle-8.5^\circ \quad \text{eq. 19}$$

$$PF=\cos(-8.5)=0.989 \quad \text{eq. 20}$$

Figure 5:
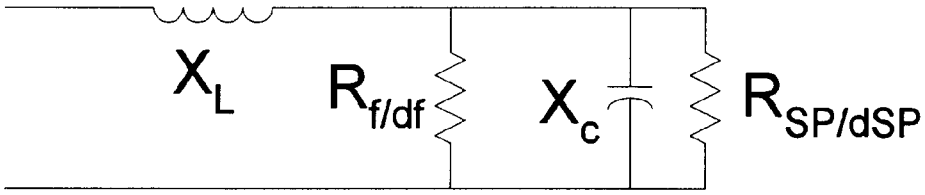
FIG. 5 is a model of FIG. 3.

The power supply load can be added to the effective circuit of FIG. 4 by placing the powers supply's model in parallel with the $R_{eff}$. FIG. 5 shows this. At 60 Hz, the impedance of the transformer is almost purely resistive. Thus assuming that the power supply is drawing 35 watts, then:

$$R_{SP} = \frac{120^2}{35} = 411\Omega \quad \text{eq. 21}$$

The impedance of FIG. 5 is:

$$Z=X_L+R_{f/df}\|X_c\|R_{SP/dSP}=134.5-j13.56=135.2\angle-5.76^\circ \quad \text{eq. 22}$$

and the power factor is:

$$PF=\cos(-5.76)=0.995 \quad \text{eq. 23}$$

Any current harmonics that may be present will start at the LC power filter resonant frequency. For the preferred embodiment in FIG. 3, the first current harmonics start near the 158th harmonic for a 50 Hz AC system and the 131st harmonic for a 60 Hz AC system. Other current harmonics start at the switch frequency. For a switch frequency of 20 Khz harmonics start at the 400th harmonic for a 50 Hz AC system and the 333rd harmonic for a 60 Hz AC system. By placing the start of any current harmonics at these high frequencies it is much easier, as well as less costly, to filter any higher order differential or common mode harmonics in order to meet conducted emissions requirements. With the expected small amplitude upper harmonic content and the fact that the component selection meets the requirements of equation 6 for presenting a resistive load to the power source this power control structure will yield a system with the desired high level of power quality, i.e. power factor, over a wide range of duty cycles and power levels.

With the specified PWM switch frequency of 20 Khz and given that it is desirable to place approximately an order of magnitude between power filter resonant frequency and the switch frequency it would be desirable to either place the power filter resonant frequency several thousand Hz lower or the switch frequency several tens of thousands of Hz higher. A lower power filter resonant frequency would require a larger and more expensive input inductor or a larger and more expensive filter capacitor. Given the limited space available in a typical laser printer it is very undesirable to increase the physical size or cost of the filter components. Further a capacitor much larger than the specified value of 2 $\mu$F starts to impact the peak currents drawn by the filter and the power factor of the converter as a whole would deteriorate. It would also be more difficult to completely discharge the filter capacitor with every half cycle of the AC power at lower duty cycles and may affect the switching losses of the switching device. Alternatively, the switch frequency could be placed at 60 Khz or 70 Khz but of course the power switch would start to experience heavier frequency dependent switching losses. Higher switching losses in the power switch are not desirable as the additional energy loss in the form of heat could possibly require more aggressive forced air cooling with the associated expense of a fan.

The ability to have very good power quality at high loads offsets the loss in power quality at lower loads where power quality is not as important. Of course the filter components can be further optimized to obtain further improvements in the impedance of the load for low duty cycles. With further refinement in filter component selection this topology will allow the AC load to appear almost purely resistive for power levels ranging from below 100 Watts to well over a kilowatt and for AC sources ranging from 50 Hz to 60 Hz and with supply voltages ranging from 90 Vrms to over 240 Vrms.

Upon reviewing the impedance phase angle and resulting power factor it is apparent that selecting a smaller capacitor for the power filter than specified above will further improve the power factor at lower duty cycles and associated power levels. Decreasing the filter capacitance would increase the resonant frequency of the power filter. In order to maintain proper separation between the filter resonant frequency and the switching frequency the power filter inductance would have to be increased, by increasing the filter inductance. The tradeoffs involved are balancing the cost of the filter components and their physical size. Increasing the inductance of a powdered iron core inductor by a few hundred microhenries can be obtained quite inexpensively with very small impact on its physical size or cost. Decreasing the size of the high power filter capacitor will generally result in a cost savings as well as a sizable decrease in its physical size. Thus reducing the filter capacitance and increasing the filter inductance will be beneficial from a cost standpoint and a physical size standpoint.

Figure 6:
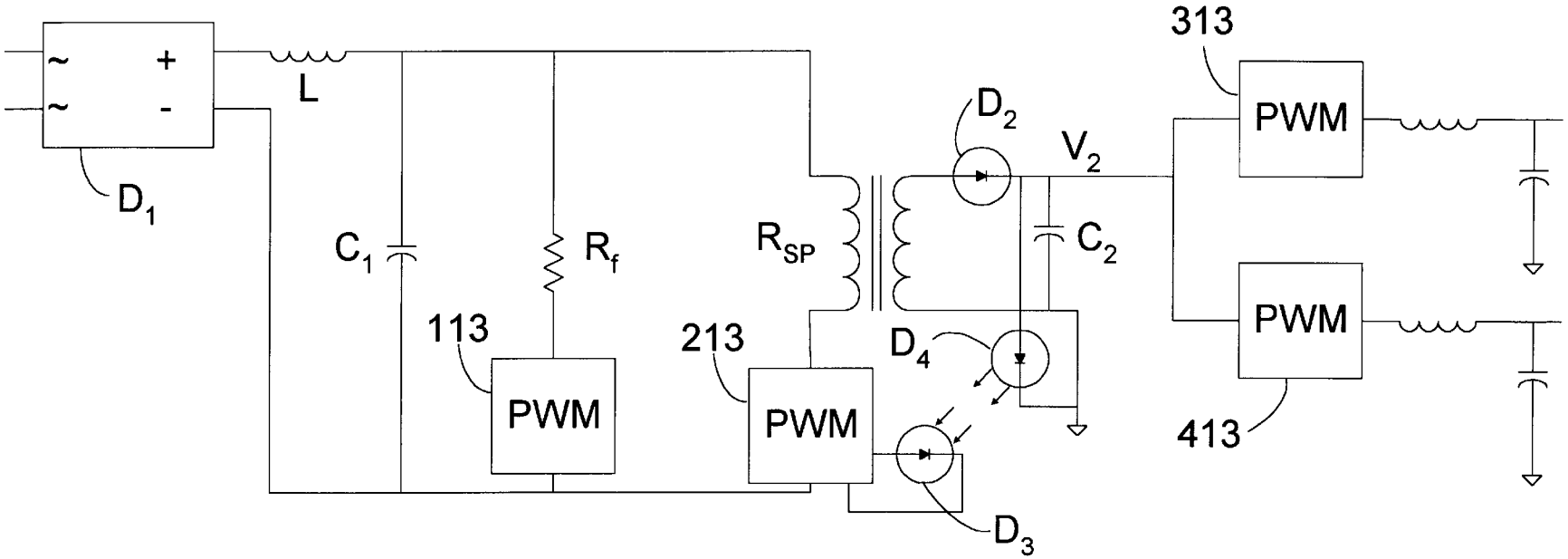
FIG. 6 is a simplified schematic diagram of the preferred embodiment in accordance with the present invention.

Referring now to FIG. 6 where a schematic of the preferred embodiment is shown. As with the diagram of FIG. 3, a secondary power supply has been added. This secondary power supply shares the filter elements (L and $C_1$) with the fuser power electronics.

PWM 213 receives feedback about the transient loads placed on the outputs through the optical link between $D_3$ and $D_4$. PWM 213 attempts to maintain a constant voltage at $V_2$, independent of the load generated by PWM 313 and 413. $V_2$ is an intermediate voltage that is further reduced to the working voltages by PWMs 313 and 413 and potentially other PWMs not shown. $C_2$ is a relative large capacitor, which functions as an energy reservoir that provides energy during peak transient demands. The response time of PWM 213 should be limited to about 50 ms to minimize the generation of current harmonics on the AC line.

Figure 7:
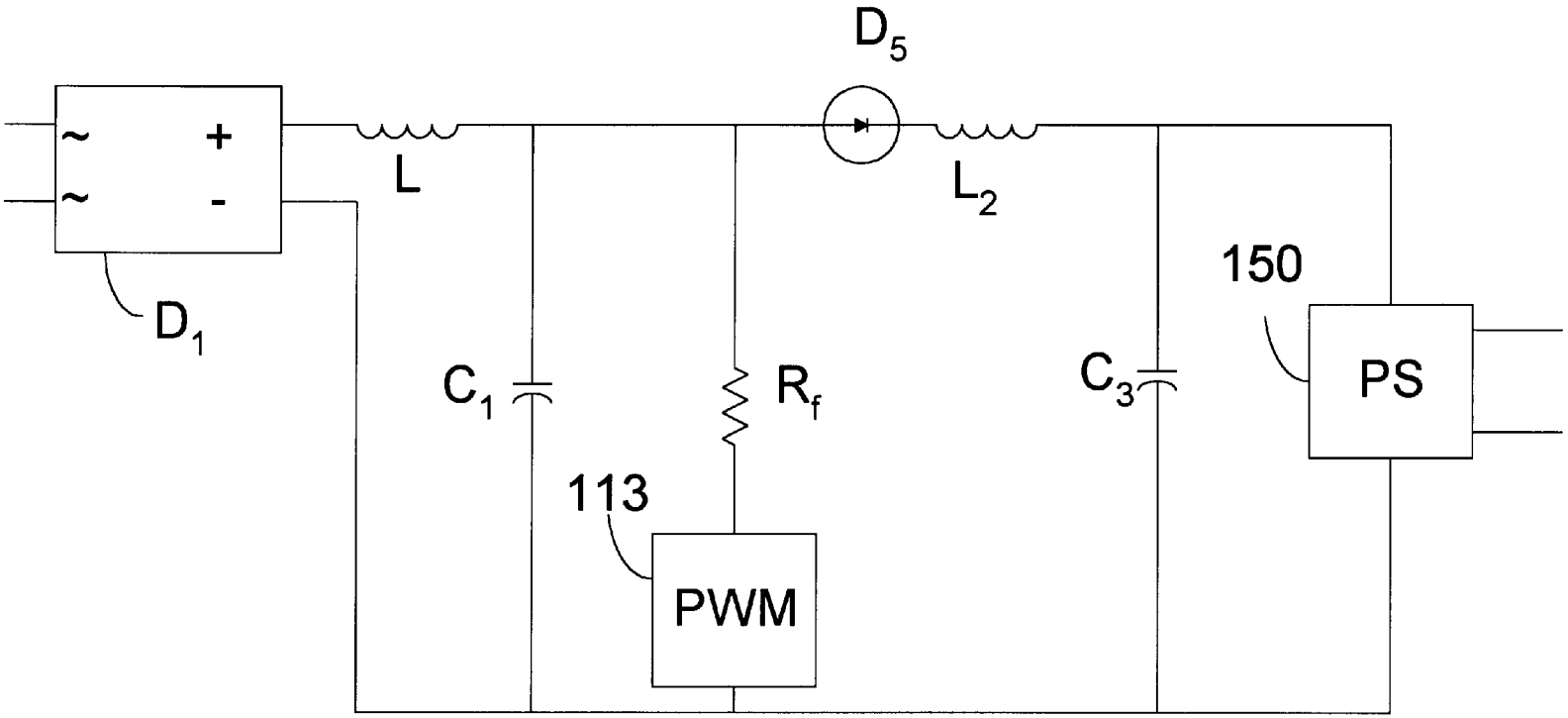
FIG. 7 is a simplified schematic diagram of an alternative embodiment.

Finally, FIG. 7 shows a schematic for adding the present invention to an existing power supply. As one skilled in the art understands, a normal switching power supply first converts the incoming AC into a DC source. The PWM (within power supply 150) converts the incoming DC into the correct DC output. Thus, switching power supplies are commonly referred to as DC—DC converters. Additionally, generally the DC—DC converter 150 also provides electrical isolation between the power source and the load.

If a power supply, which is designed to operate with a DC input is connected in parallel with $C_1$, it may not function properly because the voltage across $C_1$ drops to, or near, zero for each half cycle of the input AC voltage. Some power supplies presently installed in electrophotographic systems will malfunction if the input voltage falls below a minimum level.

By adding $D_2$, $L_2$ and $C_3$ as shown FIG. 7, power supply 150 in receives a DC input. $D_2$ prevents $C_3$ from discharging back towards $R_f$ while allowing $C_3$ to charge when ever the voltage across $C_1$ is greater then $C_3$. In essence, the $D_2$, $L_2$ and $C_3$ combination is a half-wave rectifier. Assuming that power filter inductor is in continuous conduction for nearly the entire AC half cycle, the voltage across $C_1$ is a halversine, $D_2$ can conduct every half cycle. The optional $L_2$ forces $D_2$ to remain conducting during the times that the fuser heating element $R_f$ is switched in circuit by PWM 113, thereby minimizing conducted and radiated emissions.

Figure 8:
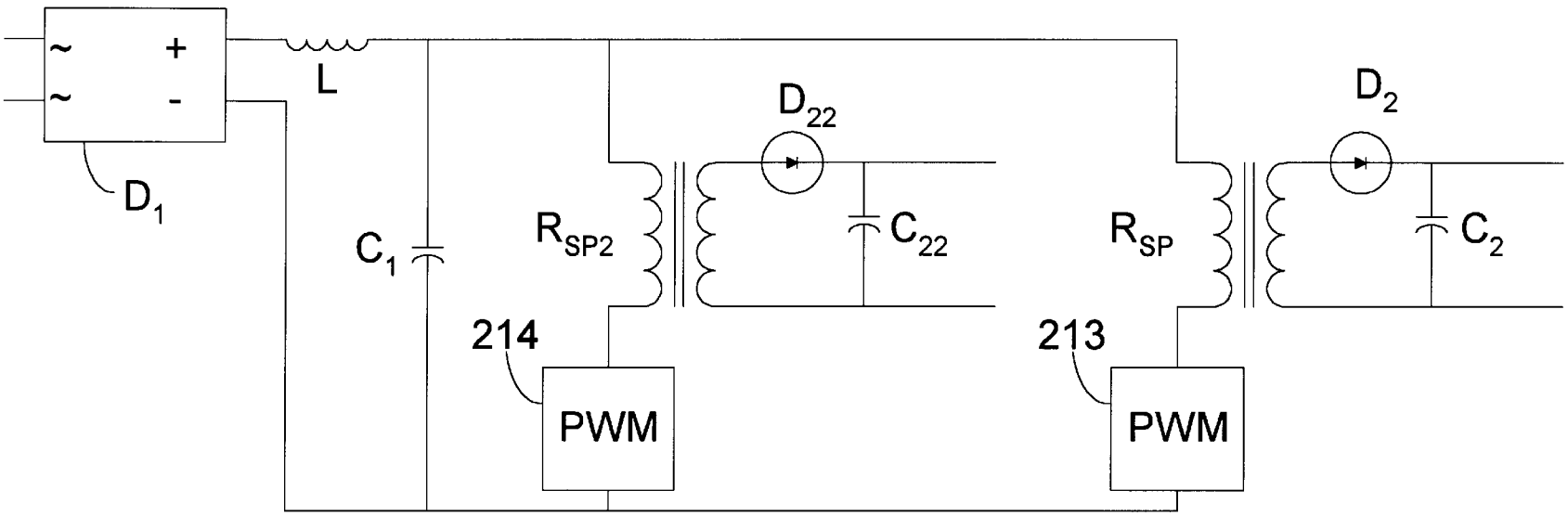
FIG. 8 is a simplified schematic diagram of an alternative embodiment.

The above descriptions and embodiments all assume that a power supply was placed in parallel with the fusing system. The embodiment in FIG. 8 shows that it is possible, using the present invention, to parallel multiple power supplies, all sharing the "front end" ($D_1$, L and $C_1$). In particular, a second power supply consisting of PWM 214, $D_{22}$ and $C_{22}$ has replaced the fusing system. The effective resistance is equal to the parallel combination of $R_{SP2/dSP2}$ and $R_{SP/dSP}$. One skilled in the art will understand that the fusing system may be retained, also, any number of power supplies may be added.

Although the preferred embodiment of the invention has been illustrated, and that form described, it is readily apparent to those skilled in the art that various modifications may be made therein without departing from the spirit of the invention or from the scope of the appended claims.

What is claimed is:

1. A circuit for generating a first and a second output, said circuit comprising:

a power source operating at a first frequency;

an inductor connected serially to said power source;

a capacitor connected serially to said inductor and said power source;

said inductor and said capacitor having a resonate frequency that is greater than said first frequency;

a first element connected to said inductor and said capacitor;

a first switch connected to said first element and said power source;

a first controller means connected to said first switch for pulse width modulating said first switch at a first PWM frequency that is greater than said resonate frequency thereby generating said first output at said first element;

a second element connected to said inductor and said capacitor;

a second switch connected to said second element and said power source; and a second controller means connected to said second switch for pulse width modulating said second switch at a second PWM frequency that is greater than said resonate frequency thereby generating said second output at said second element.

2. The circuit of claim 1 wherein said power source further comprising a bridge rectifier.

3. The circuit of claim 1 wherein:

said first element being a heating element; and said second element being a transformer having a primary side and a secondary side, said primary side being connected to said second switch and said power source.

4. The circuit of claim 3 further comprising:

a diode connected to a secondary side of said transformer; and a second capacitor connected to said diode and said secondary side of said transformer.

5. The circuit of claim 4 further comprising at least one power converter connected to said second capacitor.

6. A circuit for heating a heating element to a desired temperature and generating an output from a power source, said power source having a periodic varying voltage, said circuit comprising:

said power source operating at a first frequency;

a rectifier connected to said power source;

an inductor connected serially to said rectifier and said heating element;

a capacitor connected serially to said inductor and said rectifier;

said inductor and said capacitor having a resonate frequency that is greater than said first frequency;

a first switch connected to said heating element and said rectifier;

a first controller means connected to said first switch for pulse width modulating said first switch at a first PWM frequency that is greater than said resonate frequency thereby heating said heating element to said desired temperature;

an element connected to said inductor and to said capacitor;

a second switch connected to said element and said rectifier; and a second controller means connected to said second switch for pulse width modulating said second switch at a second PWM frequency that is greater than said resonate frequency thereby generating said output at said element.

7. The circuit of claim 6 further comprising:

a means for sensing a temperature of said heating element, said first controller means turning said first switch off and on in accordance with said means for sensing.

8. The circuit of claim 6 further comprising:

a means for sensing a voltage of said output, said second controller means turning said second switch off and on in accordance with said means for sensing.

9. The circuit of claim 8 further comprising:

said element being a transformer having a primary side and a secondary side, said primary side being connected to said second switch and said inductor;

a diode connected to said secondary side of said transformer; and a second capacitor connected to said diode and said secondary side of said transformer.

10. The circuit of claim 9 further comprising at least one power converter connected to said second capacitor.

11. A circuit for heating a heating element to a desired temperature and generating an output from a power source, said power source having a periodic varying voltage, said circuit comprising:

said power source operating at a first frequency;

a means for sensing a temperature of said heating element;

a means for sensing a voltage of said output;

a rectifier connected to said power source;

an inductor connected to said rectifier and said heating element;

a capacitor connected to said inductor and said rectifier;

said inductor and said capacitor having a resonate frequency that is greater than said first frequency;

a first switch connected to said heating element and said rectifier;

a first controller means connected to said first switch and said means for sensing said temperature, said first control means generating an temperature error indicator that is indicative of an error between said desired temperature and said temperature, said first controller means using said temperature error indicator to pulse width modulating said first switch at a first PWM frequency that is greater than said resonate frequency thereby heating said heating element to said desired temperature;

an element connected to said inductor;

a second switch connected to said element and said rectifier; and a second controller means connected to said second switch and said means for sensing said voltage, said second control means generating an voltage error indicator that is indicative of an error between a desired voltage and said voltage, said second controller means using said voltage error indicator to pulse width modulating said second switch at a second PWM frequency that is greater than said resonate frequency thereby generating said output at said element.

12. The circuit of claim 11 further comprising:

said element being a transformer having a primary side and a secondary side, said primary side being connected to said second switch and said inductor;

a diode connected to said secondary side of said transformer; and a second capacitor connected to said diode and said secondary side of said transformer.

13. The circuit of claim 12 further comprising at least one power converter connected to said second capacitor.

* * * * *